United States Patent [19]

Robbins

[11] Patent Number: 4,727,619

[45] Date of Patent: Mar. 1, 1988

[54] APPARATUS FOR CLEANING WHEEL BEARINGS

[76] Inventor: Robin S. Robbins, P.O. Box 2451, Kings Beach, Calif. 95719

[21] Appl. No.: 881,036

[22] Filed: Jul. 1, 1986

[51] Int. Cl.[4] ..... B08B 9/00

[52] U.S. Cl. ..... 15/304; 15/302; 134/169 A

[58] Field of Search ..... 15/302, 304; 134/116, 134/135, 169 A

[56] References Cited

U.S. PATENT DOCUMENTS

| | | | |
|---|---|---|---|
| 1,766,208 | 6/1930 | Anstiss | 134/116 |
| 2,160,214 | 5/1939 | Jackson | 134/123 X |
| 2,369,498 | 2/1945 | Streuber | 134/116 X |
| 2,549,837 | 4/1951 | Merritt | 134/116 X |
| 2,634,738 | 4/1953 | Fuller et al. | 134/169 A |
| 2,702,092 | 2/1955 | Douglass | 134/169 A X |
| 3,027,590 | 4/1962 | Heim | 15/304 |

*Primary Examiner*—Chris K. Moore

*Attorney, Agent, or Firm*—Herbert C. Schulze

[57] ABSTRACT

The cleaning of old grease and accumulated impurities from wheel bearings as well as the repacking of such bearings with clean grease is accomplished by mounting bearings to be cleaned in a special manner in conjunction with an appropriate brush and in such manner as to be rotatable by rotating the rotor and further in conjunction with fluid flowing through and about such wheel bearings until the old grease and impurities are removed and the subsequent repacking of the wheel bearings with fresh grease by a pressure packing device.

6 Claims, 5 Drawing Figures

APPARATUS FOR CLEANING WHEEL BEARINGS

CROSS REFERENCE TO RELATED PATENT APPLICATIONS

There are no patent applications filed by me related to the within application.

BACKGROUND OF THE INVENTION

I. Field of the Invention

This invention is in the general field of bearings, particularly automotive wheel bearings and the like. The invention is even more particularly directed to the cleaning of grease and impurities from used bearings by applying an appropriate fluid flowing in and about such bearings together with the repacking of said bearings with fresh grease as desired.

II. Description of the Prior Art

Up until the present invention, the only known methods for cleaning wheel bearings have been the use of solvents or wiping the bearings with rags or the like. The use of solvents is not a method which can be adequately used, since solvents affect the exterior surface of the bearings in such manner that the bearings will break down and become destroyed in use, as is well known to those skilled in the art.

The cleaning by rags therefore is the only practical known prior art, and such prior art does not affect, and is not related to, the presently disclosed method and apparatus.

SUMMARY OF THE INVENTION

In many automotive vehicles and the like, wheel bearings are commonly used, which wheel bearings comprise, usually, roller bearings being tapered and bearing on inner and outer surfaces thus supporting the rotation of a wheel about an axle.

The wheel bearings most commonly used are packed in grease or the like to prevent metal to metal contact which would be destructive of the bearings or the races on which they operate.

The bearings are generally sealed quite well so as to avoid unnecessary contamination with exterior contaminants. However, due to the nature of such bearings they cannot be completely sealed so as to avoid some intrusion of impurities. Also, continued use over a long period of time has a tendency to break down the grease and it may lose its full effectiveness.

For the above reasons, it is common to clean wheel bearings at periodic intervals. Since the surface of the wheel bearing, as it known to those skilled in the art, is adversely affected by the use of most known solvents, it has never been possible to dissolve the grease properly and maintain an effective and reliable wheel bearing after repacking. For this reason, the most common way to clean wheel bearings is by means of rags or the like which are used by hand to wipe the old grease out of and off of used bearings. This is a tedious and time consuming process and it does not always result in all impurities being removed. There are certain fluids which can be used under pressure to remove old grease, but up until now there has been no practical way to utilize such fluids as are available. These fluids are not like solvent in that they are not dissolving the grease, but are being applied strictly as fluids under high pressure and thus removing, by force, the old grease of the like.

I have devised a complete method and apparatus for the cleaning of wheel bearings in an effective way by high pressure fluids and for the repacking of wheel bearings with fresh grease after they have been cleaned of all of the old grease. I have accomplished this by providing means to apply a carrier fluid under pressure to the bearings being held in conjunction with its wheel, and with the use of an auxiliary brush whereby the grease or the like in an old bearing can be flushed out, thus leaving a clean bearing, without the necessity of wiping with rags or the like, and in which a solvent is not used therefore the surface of the bearing is not affected. I have also added, for optional use, means to repack the bearings with grease after they have been thoroughly cleaned.

Thus, I am combining in one method and apparatus a means to more efficiently clean automotive wheel bearings or the like and then to repack such bearings with fresh grease.

It is an object of this invention to provide a method and apparatus for flushing old grease and impurities from automotive wheel bearings without using a solvent;

Another object of this invention is to provide such a system for flushing the wheel bearings wherein a non-harmful fluid is utilized;

Another object of this invention is to provide in conjunction with an apparatus to flush the old grease and impurities from wheel bearings, an auxiliary and cooperative piece of equipment to repack such bearings with fresh grease for appropriate reinstallation and further use.

The foregoing and other objects and advantages will become apparent to those skilled in the art upon reading the following description of a preferred embodiment in conjuction with a review of the appended drawings.

DESCRIPTION OF A PREFERRED EMBODIMENT

Figure 1:
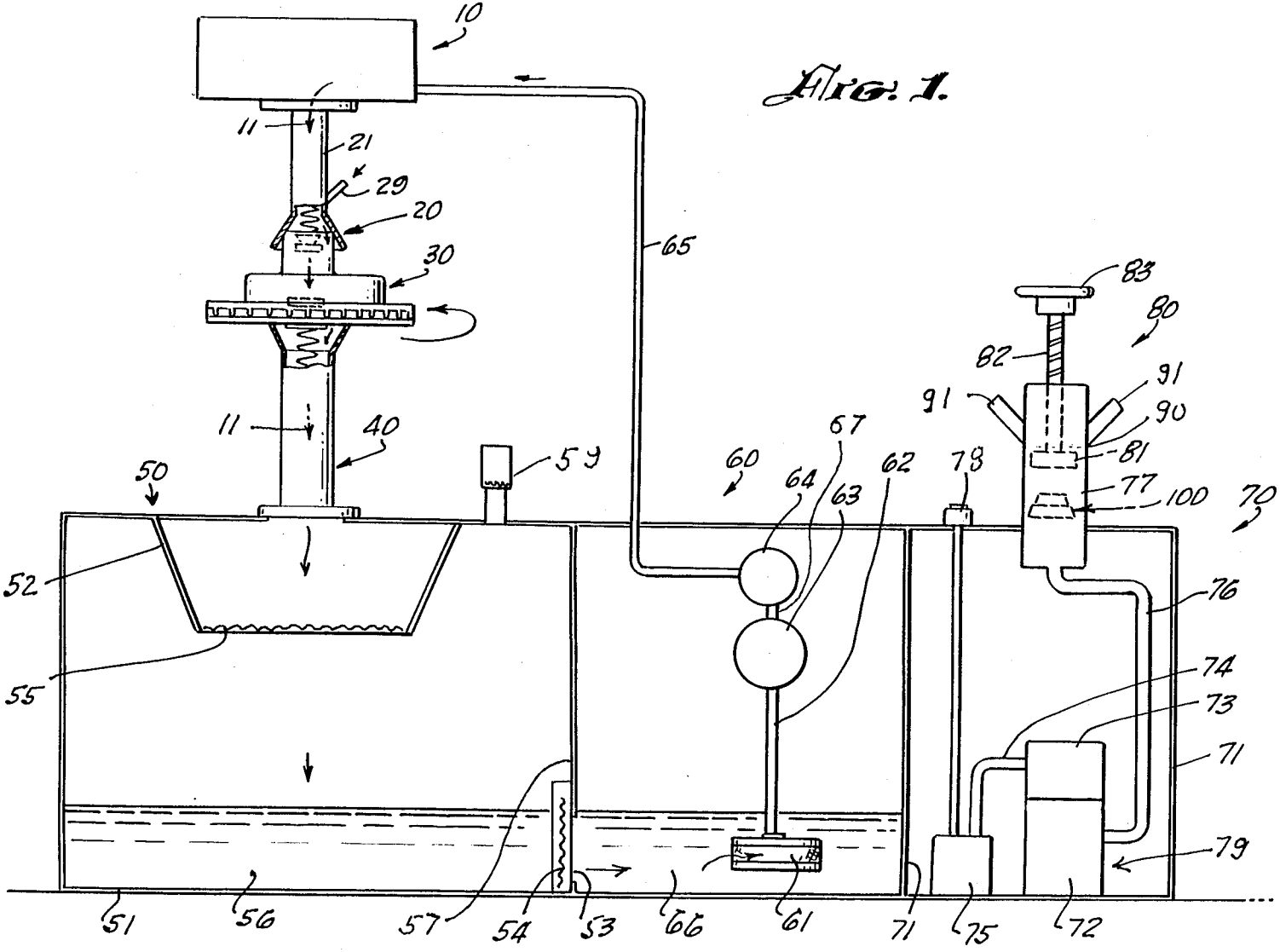
FIG. 1 is a schematic view of a preferred apparatus to practice the method of this invention with certain of the elements which would normally be enclosed being shown open for understanding the description which follows.

FIG. 1 is a schematic representation of a machine to do the entire job of cleaning wheel bearings in an appropriate fashion. The element generally 10 is a chamber as well as a bearing position, which will obviously be anchored appropriately to a building wall or a framework. Also, it can be free standing on top of the overall mechanism although preferably it will be mounted and held from above. Normally it would be slidably mounted in such manner that it could be raised or lowered as desired.

Fluid 11 will enter into this chamber 10 through an appropriate conduit or the like 65.

The fluid 11 will follow the path indicated by the arrows and will drop into the sump area at which point it is mixed with impurities from the bearings being cleaned. The fluid will be dropping through the chamber 52 with a screen 55 for filtering and then on into the general sump fluid 56 where it passes through another filter 54 through an opening 53 in wall 57.

The fluid 66 will now be quite clean and it is pumped by way of pump 64 through a filter 63 and also through a filter 61 passing by conduit means 62 and 67 and 65 into the reservoir 10 as previously described.

In this manner, the fluid 11 and fluid 66 may be the same identical material or, it is possible that the character of fluid 66 will be somewhat modified by the filters in the pumping line.

At 29 there is provision for injection of air into the main fluid conduit 21 so that the fluid 11 may be mixed with air, or air may become the sole fluid used. Under the proper conditions of pressure and temperature, air can also operate in this method and apparatus to be the fluid which carries the grease from the bearings. During the cleaning operation the wheel may be turned in such manner as to assist in the cleaning operation, particularly in connection with the brushes which will be described below.

Before describing in detail the operations and mechanism of the cleaning apparatus, is should be noted that another compartment area 70 has been provided. Thus there are three compartment areas 50, 60, and 70. 70 is completely and totally isolated from the area 60 by solid wall 71 which is also the numeral which designates the entire compartment 70 on all sides top and bottom.

A container 79 is provided which contains a quantity of grease 72. Above the grease at 73 is an air chamber which receives air through conduit 74 and air pump 75. The air pump is controlled at 78 in customary manner. The air pump will receive power as will the pump 64 from customary power sources. The grease 72 will pass through conduit 76 and into the chamber 77. Within the chamber 77 will be the bearing 100. A press such as a screw press generally 80 comprising a screw with internal threaded connections in chamber 77 (not shown) and a handle 83 can be utilized to press piston 81 downward so as to provide as much pressure in the packing of the bearing as may be desired. The bearing will be held in place by a heavy grid or the like (not shown) but as will be understood by those skilled in the art. When desired, the chamber 77 may be opened at its upper end or at an intermediate connecting position as at 91 which may be threaded and operated by handles 91 or may be clamps of various types again operated by activating devices 91 of customary construction.

Figures 2, 2A:
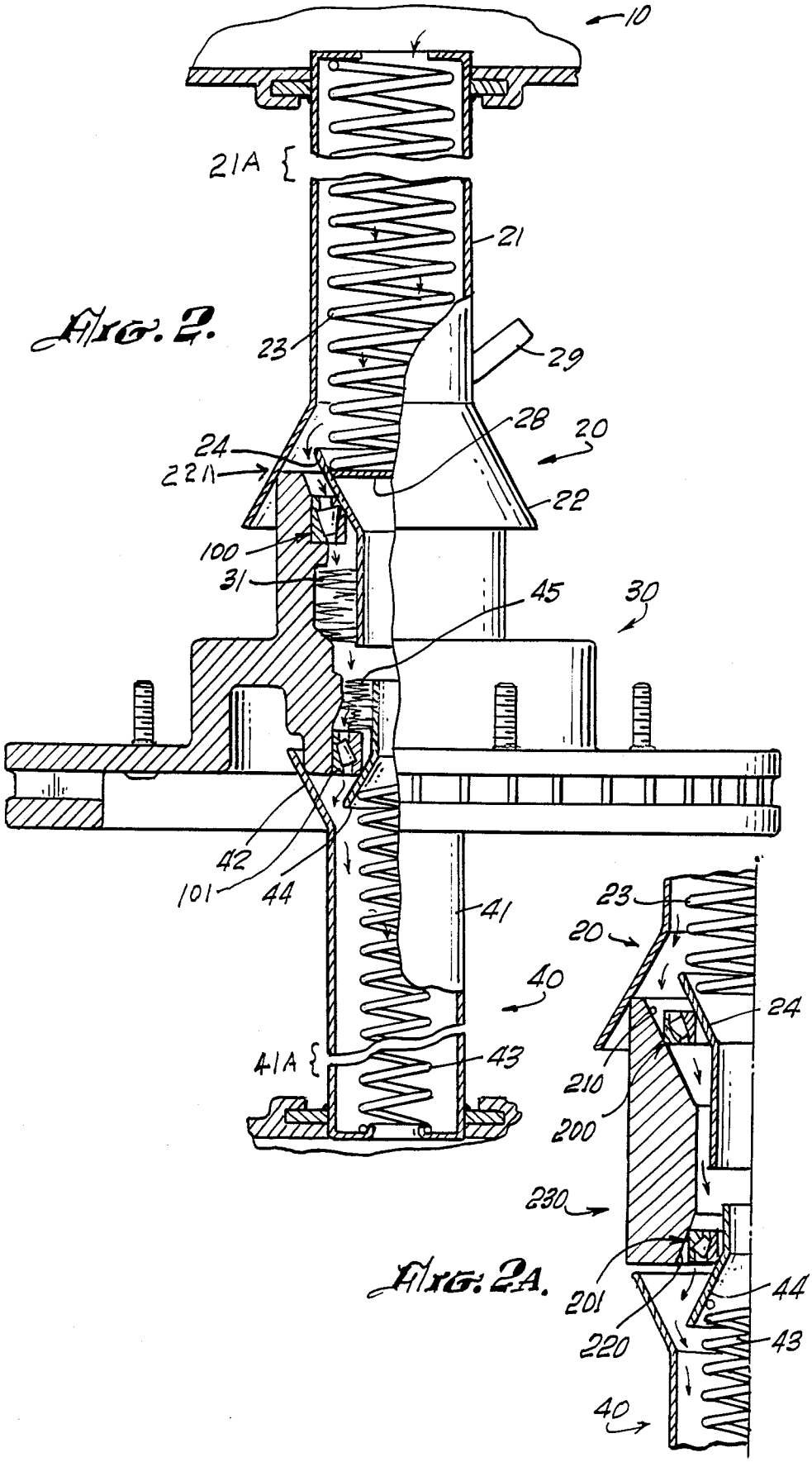
FIG. 2 is a detailed view of the area 20-30-40 of FIG. 1 in which certain portions are broken away and certain portions are in section, and in which certain portions are schematically illustrated.
FIG. 2A is a partially sectioned partially schematic partial view as FIG. 2 but showing an alternate embodiment in which a fixture is used rather than a wheel to hold the bearings being treated.

Turning attention now to FIG. 2 we see in more detail certain elements of the operating apparatus for cleaning the bearing. The wheel generally 30 which can be of many different constructions contains the bearing generally 100 and is mounted and held in position by funnel shaped end 42 on conduit 41. An interior funnel shaped apparatus as shown at 44 is provided as indicated so as to provide proper passage for the cleaning material about the bearing and thence down through conduit 41. The spring 43 maintains an upward pressure on the funnel element 44. A brush 45 will be held in position and will assist in the cleaning of bearing 101 while a brush at 31 will also be held in position and will assist in the cleaning of bearing 100. The fluid used in cleaning will come down through conduit 21 and will be diverted from going inside the funnel element 24 by an appropriate closure 28 or the like. The cleaning fluid cannot be lost from the exterior of the wheel housing since this is seen to be closed where the funnel skirt 22 engages the outer edge of the wheel cylinder at *22a*. The spring 23 exerts a downward pressure as will be clear to those skilled in the art and the spring 43 exerts an upward pressure thus keeping everything in a fluid tight condition.

In operation, the fluid will flow freely around and through both bearings and the cleaning action can be enhanced by turning the wheel wherein the bearing will be brushed by the brushes at the same time as the fluid will be caused to turbulate by such turning.

Additionally, the air being injected through the opening 29 either as the sole fluid or in cooperation with another fluid, will further enhance the preceeding.

Because of the fact that air will be injected from time to time, it is to be understood that there will be an air vent 53 (FIG. 1), probably with a filter incorporated therein as is well known in the art.

Brief mention has been made of the necessity from time to time for movement of either the upper supporting conduit 21 or the lower supporting conduit 41 in order to insert and remove a wheel with its bearings.

This can be accomplished in many ways, including a sliding collar connection (not shown), but which would be incorporated into the broken away areas 21*a* and 41*a*. This would be a customary spring loaded sliding collar or a threaded collar or other threaded connection which allows for upward and downward movement as the case may be of each of those segments. Details of this construction have not been shown because they in themselves would not be other than customary art. Their incorporation into the unique combination of other elements is not felt to add or detract, but may be necessary from the standpoint of a practical operating device.

Figure 3:
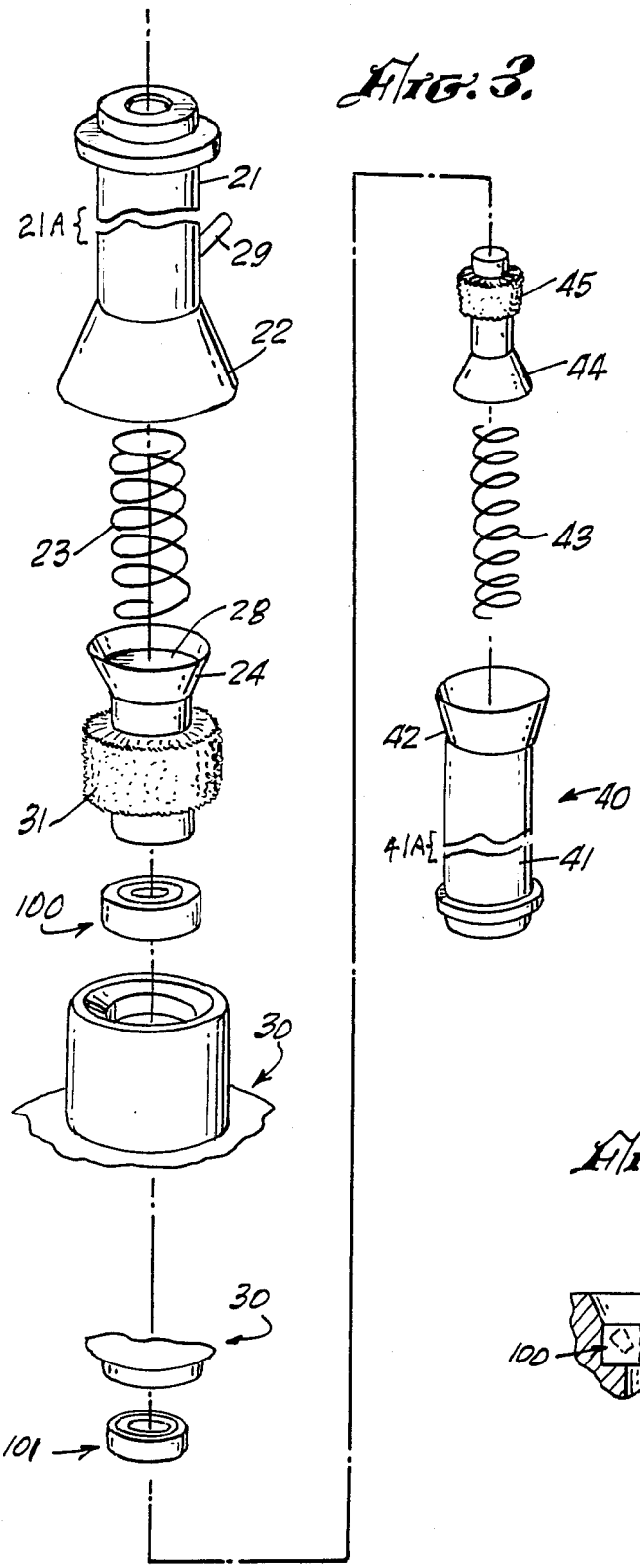
FIG. 3 is an exploded view of the apparatus of FIG. 2.

FIG. 3 is an exploded view showing all of the elements which have previously been described from FIG. 2. The scale is reduced but all of the various elements are shown. This has been shown for an understanding of the unique nature of this overall combination. The description of the elements will not be repeated for sake of brevity.

Figure 4:
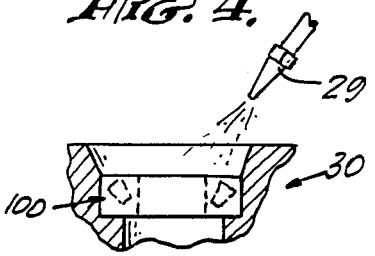
FIG. 4 is a partially schematic partially sectioned view of the bearing 40 in its cleaning area illustrating a jet of air as a cleaning fluid.

FIG. 4 illustrates in a little more detail the way the air injection 29 would appear without showing the entrance through the conduit 21. As can be seen, pressurized air will help turbulate another cleaning fluid such as denatured alcohol or air.

FIG. 2A which has not previously been commented upon shows an alternate embodiment and can be compared very easily to the general structure as shown in FIG. 2. In this particular case the change is that the member 230 is now used instead of a wheel for holding the bearings while they are being cleaned. In this case it will be noted that the member 230 has a tapered cone like end 210 and 220 on its two ends. By using this taper different size bearings can rest as shown at different places along the ramp created by the cone like section. A bearing 200 is shown and a bearing 201 is shown.

The other elements are the same and have the same reference numerals. Thus, the bearing will be held by the elements 24 and 44 as indicated and because of their tapered nature and the spring pressure from springs 23 and 33 the bearing will be held in position on the sliding surface of the interior of the element 230. Thus depending upon the size of the bearing, the element 44 will ride higher or lower as will the element 24 so as to maintain the bearing in position while the cleaning action takes place by the cleaning fluid.

While the embodiment of this invention shown and described is fully capable of achieving the objects and advantages desired, it is to be understood that such embodiment has been for purposes of illustration and not for purposes of limitation.

I claim::

1. Apparatus for cleaning bearings in automotive wheels comprising a pair of fixtures to hold said wheel at positions adjacent the bearings in said wheel; means associated with said pair of fixtures suitable to pass a cleaning fluid to the interior of the wheel and in contact with the bearings so as to remove grease or other matter from the bearings; means to receive said fluid after it has passed through said wheel; and brush means associated with said pair of fixtures in such manner that the wheel may be rotated causing the brush means to assist in removing grease or other impurities from the wheel bearings.

2. The apparatus of claim 1 wherein the cleaning fluid is circulated through and around said bearings while held in said pair of fixtures.

3. The apparatus of claim 2 wherein fluid circulation means are provided in cooperative conjunction with said pair of fixtures to allow for passage of said fluid through said bearings and through a filter into a holding tank.

4. The apparatus of claim 3 wherein air under pressure comprises at least a part of the cleaning fluid.

5. The apparatus of claim 4 wherein air filter means interconnect with the air under pressure.

6. The apparatus of claim 5 wherein there is connected to the said holding tank a chamber containing means to hold grease and means to pressurize said grease and conduit means connecting said grease holding means to a bearing packing means.

* * * * *